United States Patent [19]

Martin et al.

[11] 3,999,303

[45] Dec. 28, 1976

[54] APPARATUS AND METHOD FOR TOBACCO HANDLING AND CURING

[76] Inventors: William Kearns Martin, Rte. 2, Box 11; Dale Lamon Miller, 1932 Oxford Road, both of Henderson, N.C. 27536

[22] Filed: Jan. 2, 1976

[21] Appl. No.: 646,169

[52] U.S. Cl. ..... 34/12; 34/216; 34/217; 432/500

[51] Int. Cl.[2] ..... F26B 7/00

[58] Field of Search ..... 432/500; 34/12, 216, 34/217, 201, 236

[56] References Cited

UNITED STATES PATENTS

| | | | |
|---|---|---|---|
| 3,295,222 | 1/1967 | Geitz | 34/201 |
| 3,503,137 | 3/1970 | Wilson | 432/500 X |
| 3,804,272 | 4/1974 | Horne | 432/500 |
| 3,935,648 | 2/1976 | Cox | 432/500 |
| 3,935,959 | 2/1976 | Long | 432/500 |

*Primary Examiner*—John J. Camby
*Attorney, Agent, or Firm*—B. B. Olive

[57] ABSTRACT

A tobacco handling and curing system is provided for in-the-field loading of tobacco leaves into a rectangular curing box and for securing the tobacco leaves within the box by means of a plurality of spikes. The curing box is transferred to a tobacco barn where it is lifted and rotated 90° by a hoist and loaded into the tobacco barn by means of a roller and track arrangement. The tobacco barn is provided with a downward air flow system having uniform temperature and flow rates.

6 Claims, 7 Drawing Figures

APPARATUS AND METHOD FOR TOBACCO HANDLING AND CURING

BACKGROUND OF THE INVENTION

1. Field of the Invention

The invention relates to the handling and curing of tobacco. More particularly, the invention relates to an efficient tobacco handling and curing system adaptable for use with existing tobacco trailers and slides and requiring only one handling of the tobacco leaves through the curing stage.

2. Description of the Prior Art

It has been the practice for laborers to travel between the rows of tobacco, hand prime tobacco leaves and transfer such leaves to the barn site on a trailer or slide. The leaves are then secured to tobacco sticks for curing on the tier poles provided in stick-type tobacco barns. This method of tobacco harvesting and curing requires that the leaves be handled repeatedly and in small quantities.

Bulk curing of tobacco on "racks" as generally described in U.S. Pat. No. 3,105,713 has become increasingly popular in recent years as a means of eliminating the cumbersome stringing operation involved in the conventional method. Bulk curing systems require that the tobacco be cured in closely packed bundles. Thus, it is extremely important that large amounts of warm air be forced through the tobacco leaves and that means be provided to carry away the moisture. The bulk curing systems of the prior art have the principal disadvantage of occasional uneven drying and curing due to an insufficient flow of air through the curing leaves.

The most recent known development in the curing of tobacco is the use of large curing boxes which are filled with green tobacco leaves in the field. The leaves are compressed and held securely within the curing boxes by "spikes" or "pins" which extend through the boxes and pierce the leaves. The boxes are then loaded into the tobacco barn for curing by forcing hot air through openings in the boxes. The known curing processes utilizing the curing box approach are the system described in U.S. Pat. No. 3,834,137 to Long Manufacturing Company of Tarboro, N.C., and the "Thermal" handling and curing system manufactured by Carolina Thermal Company of Charlotte, N.C.

The bulk curing barns of the prior art utilize both the down-flow and up-flow techniques for circulating the heated air. No system known to the applicants provides a uniform static pressure between the blower and the leaves in order to assure a uniform flow of hot air throughout the barn. A typical down-flow system for bulk curing tobacco on conventional racks is the "BULKTOBAC" system designed by Gas-Fired Products, Inc., of Charlotte, N.C.

A study of the prior art indicates that there is an acute need for a bulk tobacco curing system enabling the tobacco farmer to cure large quantities of closely packed tobacco in a tobacco barn having an even drying temperature throughout and sufficient air flow to dry all the leaves evenly.

SUMMARY OF THE INVENTION

According to the apparatus and method of the present invention, a tobacco handling and curing system is provided to greatly simplify the arduous task of priming, transferring and curing tobacco. A standardized curing box having a capacity to hold approximately 1,100 pounds of "green" tobacco is adapted to be moved between the rows of tobacco on a conventional trailer or slide. In a first orientation, the curing box is placed on the trailer or slide and has an open top for filling of the box. The leaves are preferably placed within the box in three rows so that the leaves are substantially flat and parallel with the bottom of the box and so that the stems of the leaves are facing in the same direction. Once the box is full of tobacco leaves, a plurality of spikes mounted on three spike strips are depressed downwardly through the open top and thereby caused to pierce the leaves so as to compress them and secure them in place. The box is transferred to a bulk curing tobacco barn where it is hoisted and rotated 90° to a second orientation so that the leaves are supported in a vertical orientation by the spikes. In this second orientation, the top of the box is a wire mesh and the lower side of the box is removed to provide a curing box adaptable to downflow circulation. The box is transferred into the barn on rollers located on the side of the box. The rollers ride on horizontal tracks which are secured to the barn walls.

The tobacco is cured by a down-flow system having a conventional blower and heater arrangement. The hot air is blown into a plenum chamber with a turbulent flow characteristic so as to allow a static pressure to build up in the chamber. The air is forced through a pegboard surface at the base of the plenum chamber and into the curing boxes at a uniform rate.

DESCRIPTION OF THE PREFERRED EMBODIMENT

Figure 1:
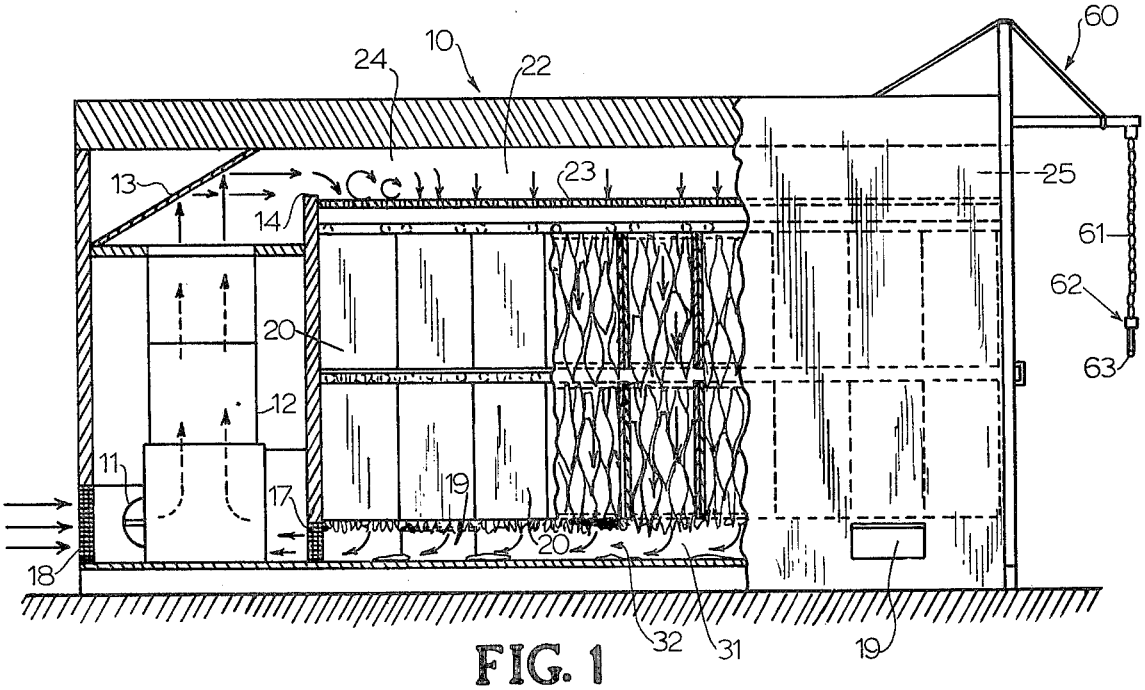
FIG. 1 is a side elevational view of the tobacco barn loaded with the curing boxes and with portions of the barn sidewall and curing box walls removed for purposes of illustration.

Referring to the drawings, a bulk curing tobacco barn 10 is adapted to hold 18 curing boxes 20 in two levels. Barn 10 utilizes a downward flow of forced air for curing. The air is forced by blower 11 upwardly through a heater 12 and is deflected by a deflector 13 into a plenum chamber 22. Chamber 22 is bounded above by the roof of barn 10 and below by a pegboard sheet 23 which covers the entire area above the curing boxes. Pegboard 23 serves to create an adequate static pressure in chamber 22 so that the forced air will be blown into the curing section of barn 10 with sufficient force. It has been found that if air from blower 11 is blown directly into chamber 22, an uneven static pressure is created within chamber 22. The uneven pressure distribution results from the laminar nature of the flow in the first few feet of chamber 22 closest to the deflector 13. As a result of the laminar flow, there is a low pressure at point 24 which increases along the length of pegboard 23 to a high pressure "head" at point 25. In order to provide an even pressure throughout chamber 22, a baffle 14 extending approximately one inch upward is provided across the entire width of barn 10 at the rear of pegboard 23 adjacent deflector 13. Baffle 14 serves to assure that the air entering chamber 22 has sufficient turbulence to eliminate the laminar flow over pegboard 23 as at point 24.

The heated air in chamber 22 is forced through the holes in pegboard 23 and directed downwardly through the tobacco in boxes 20 to a blower intake 17. The intake air to blower 11 consists of a selected amount of outside air from adjustable damper 18 and the exhaust air from blower intake 17. A number of vents 19 are provided along the base of barn 10 to exhaust an amount of air corresponding to the amount taken in by damper 18. As is well known in the art, during initial curing of the green leaf a large amount of the circulating air must be exhausted through vents in order to remove the high amount of moisture taken from the leaves. During the later stages of curing, the heated air can be essentially recirculated with minimum venting in order to completely dry the leaf. In either case a uniform pressure is held in chamber 22.

Figure 3:
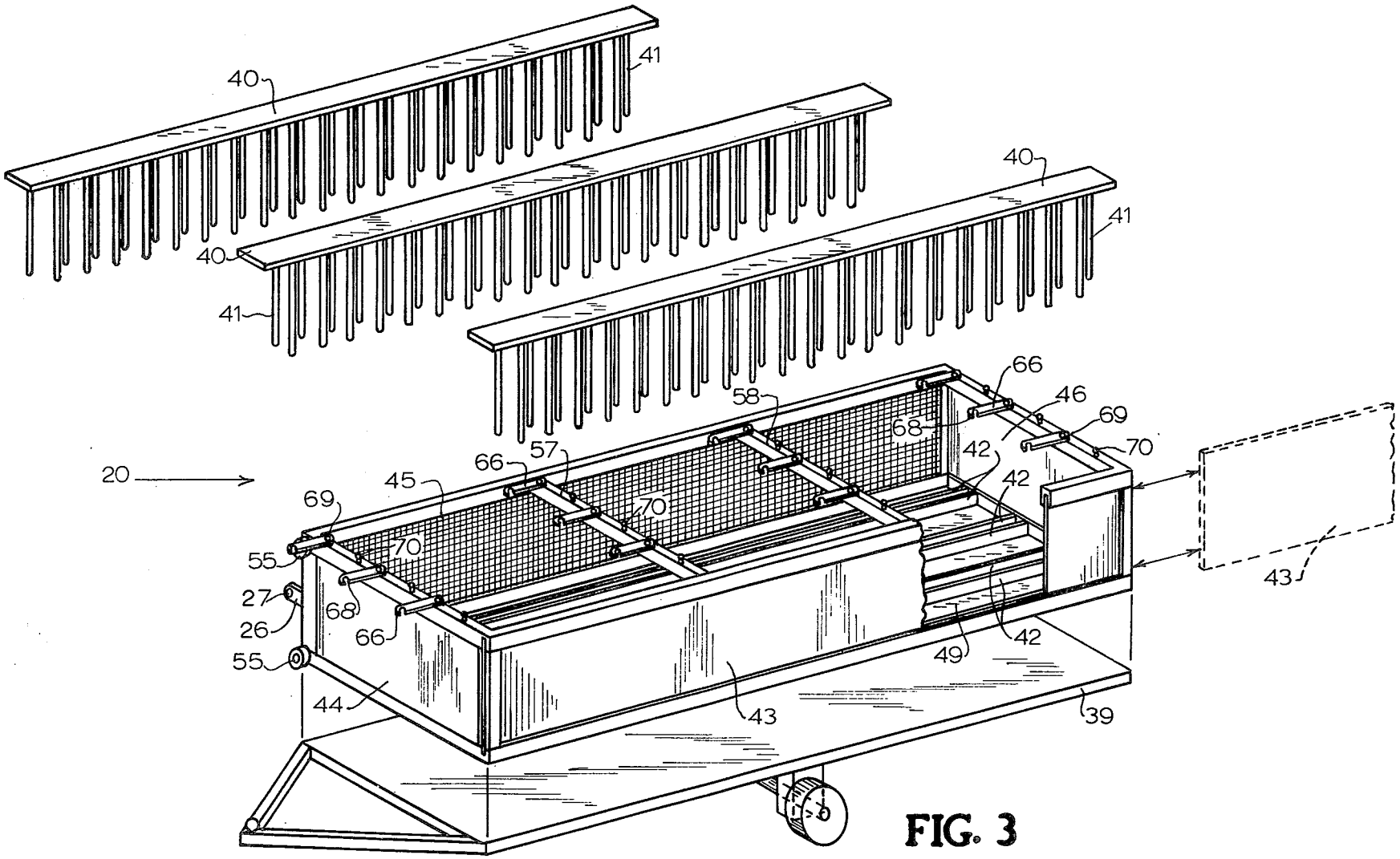
FIG. 3 is an exploded perspective view of the curing box as shown on a conventional trailer in a tobacco field.

The description will now turn to a detailed description of the curing box 20. As shown in FIG. 3, box 20 is positioned on a conventional tobacco trailer 39 of the type adapted to move between the rows of tobacco during priming of the tobacco leaves. Box 20 comprises four side members 43, 44, 45, 46 and a bottom 49. A pair of cross-members 57, 58 lend structural support to the box. Side 45 is made from a heavy gauge wire screen. Side 43 is constructed so as to be slidably removable for removing during the curing process. As will be described in detail below, box 20 is rotated 90° before it is loaded into barn 10 so that hot air may flow down through screen side 45 and exit through the opening created by the removal of side 43. A pair of arms or extensions 26 having holes 27 project from sides 44, 46 to receive rods 63 for engaging a hoist during the lifting and rotation operation. In the preferred embodiment, box 20 is approximately 2 feet by 3½ feet by 10½ feet which makes it readily adaptable for being placed on the conventional tobacco trailers or slides. Box 20 is adapted to be filled with approximately 1,100 pounds of "green" tobacco leaves. For the best air circulation and curing results, it is preferable that the tobacco leaves be placed in box 20 with the tips facing towards removable side member 43 and with the leaves substantially flat and parallel with bottom member 49. It has been found that the approximately 3½ foot width of box 20 provides room for approximately three rows of tobacco leaves with the middle row overlapping each of the outer rows somewhat. Once box 20 has been filled with tobacco leaves so that the leaves are preferably stacked above the top surface of the box, three spike strips 40 are placed against the leaves so that a plurality of spikes 41 pierce and compress the leaves. Spikes 41 on each strip 40 are arranged in two rows. Strips 40 are pressed into the leaves at spaced intervals so that spikes 41 will pierce virtually all of the leaves within the box 20. Strips 40 are adapted to be secured to box 20 at their ends and at two points intermediate their lengths by retainer latches 65.

Figure 6:
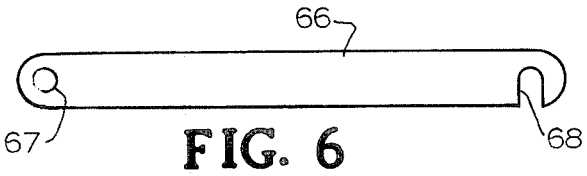
FIG. 6 is a plan view of one of the latch bands.
Figure 7:
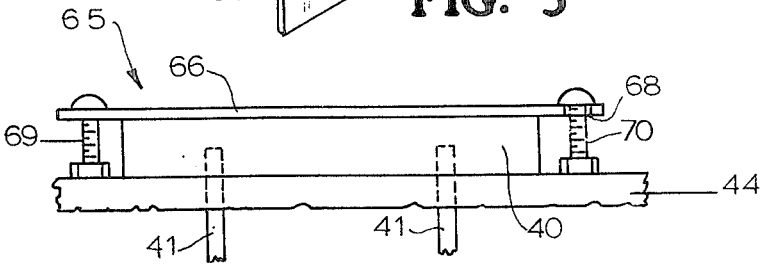
FIG. 7 is a side view of a latch and spike strip arrangement.

As best shown in FIGS. 6 and 7 each retainer latch 65 comprises a metal band 66 having a hole 67 and a recess 68 at opposite ends. For each latch there are a pair of screws 69, 70 located on the top surfaces of one of sidewalls 44, 46 or cross members 57, 58. Screw 69 is placed through hole 67 and secures band 66 to the top of the selected member. Band 66 is thereby adapted to pivot about screw 69. Once the spikes 41 are passed through the leaves, each strip 40 may be secured in place by four latches 65 located on sidewalls 44, 46 and cross members 57, 58. This latching is accomplished by pivoting each band 66 over the top surface of strip 40 until recess 68 is positioned under the head of its respective screw 70. The inherent resiliency of band 66 serves to exert a downward force on strip 40 and thereby hold the strip in place. As best shown in FIG. 3, there are twelve latches 65 employed to secure the three strip members 40. Six ledge formations 42 are provided on the interior surface of bottom member 49 in order to provide support for the end portions of each row of spikes 41 after the spikes have been inserted and box 20 has been rotated 90° as described below. Spikes 41 can be inserted into the tobacco either in the field or at the tobacco barn.

Figure 4:
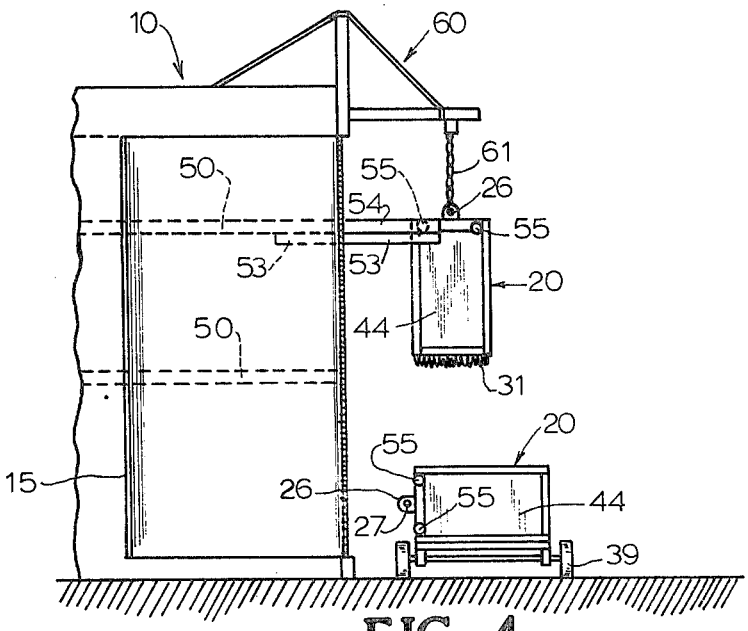
FIG. 4 is a side view of the front portion of the tobacco barn showing the curing box in a first position as it is about to be hoisted and in a second position after it has been hoisted and rotated 90°.

Once the box 20 has been filled with tobacco and strips 40 have been secured by latches 65, box 20 is brought to a point below a hoist 60 mounted on the front of barn 10 (FIG. 4). Hoist 60 has a chain 61 and a bracket member 62 attached to the end of the chain 61. Bracket 62 has two rod members 63 adapted to engage holes 27 in arms 26. The raising of chain 61 causes box 20 to rotate 90° so that removable side member 43 is now positioned at the bottom of the box. While box 20 is off the ground and before inserting the box into the barn, side 43 is removed so that the tip portions 31 of the lowest layer of tobacco leaves can hang out the bottom of the box 20. The removal of side 43 and the positioning of screen side 45 at the top of box 20 provides a path for the downward flow of air through box 20. It has been found that by arranging the leaves in uniform rows with the stems facing upward and the tips facing downward, an optimum air flow through the box can be achieved. The air first flows by the stems with little resistance and after taking on a laminar flow over the leaves, the air flows past the tips. The known prior art devices and methods employ a random placement of leaves in the box whereby the air flow is necessarily non-uniform resulting in uneven drying.

Figure 5:
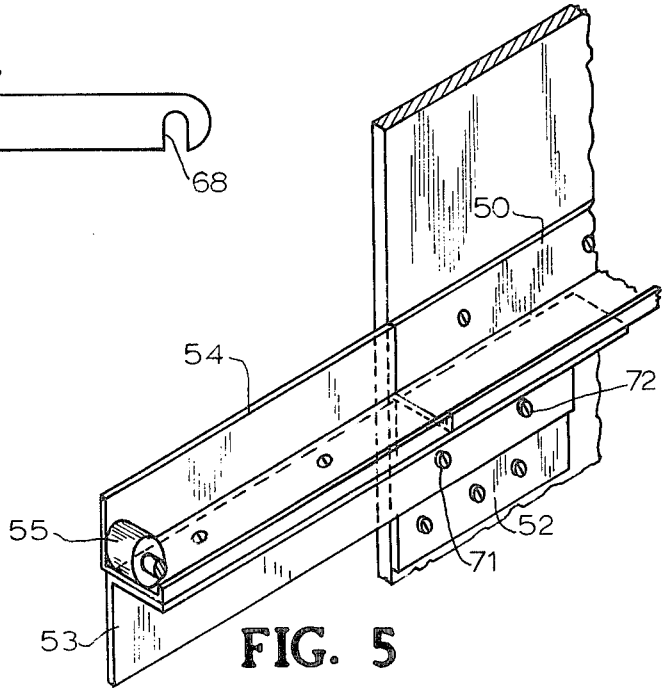
FIG. 5 is an enlarged fragmentary view of the roller, track and track extension assembly used for loading and supporting the curing boxes in the tobacco barn.

A pair of rollers 55 are located on each end of box 20 and are adapted to engage and be supported by a set of fixed tracks 50 located along the inner walls of barn 10. Tracks 50 are located on each side of barn 10 and, in the preferred embodiment, two levels of tracks are provided to accommodate two levels of boxes 20 for curing. Preparatory to rolling boxes 20 into barn 10, an extension assembly 51 is added to each of the four tracks 50 as illustrated in FIG. 5. Assembly 51 includes a securing plate 52, an extension arm 53 and an extension track 54. Plate 52 is bolted to the barn sidewall adjacent the doors and just below track 50. Arm 53, which is an angle piece, is bolted to the barn sidewall and plate 52 by a pair of bolts 71, 72. Extension track 54 is permanently secured to the top of the outwardly protruding portion of arm 53 by welding, bolts or other suitable means. Extension track 54 thus extends outwardly from barn 10 and abuts the end of track 50 at the front edge of the barn sidewall. The extension assemblies 51 extend far enough from barn 10 to engage the rollers 55 as box 20 is suspended by hoist 60. After the boxes are loaded, the arms 53 and extension tracks 54 are removed simply by withdrawing their respective bolts 71, 72.

Figure 2:
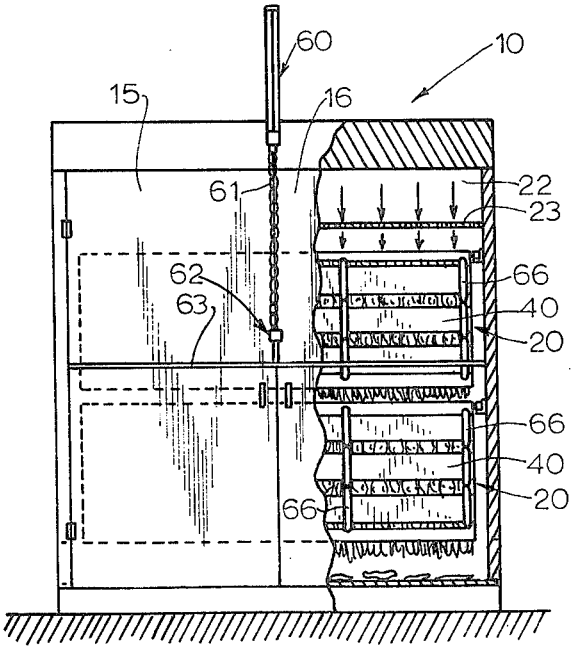
FIG. 2 is a front view of the tobacco barn with a portion of one door removed to show the curing boxes therein.

Barn 10 has two doors 15, 16 which extend across the front of the barn. As shown in the cutaway portion of FIG. 2, the operator may determine the progress of the curing process simply by opening one of the doors and viewing the tobacco exposed between the three spike stripes 40.

In operation, box 20 is loaded onto a conventional trailer 39 or slide with bottom member 49 facing downward. The trailer 39 is then moved between the rows of tobacco in the conventional manner so that box 20 may be filled with hand primed tobacco leaves. The leaves are preferably arranged in three rows with the stems facing toward screen side 45 and the tips toward removable side 43. Once box 20 has been filled with tobacco leaves and is preferably "overflowing" with such leaves, spikes 41 are caused to pierce the rows of leaves so as to compress the leaves and hold them in place. Each of the three spike strips 40 are held in place by four latches 65.

Trailer 39 and box 20 are next positioned below hoist 60 so that rods 63 of bracket 62 may engage lifting holes 26 on arms 27. The hoist is energized so that box 20 is lifted off of trailer 39 and simultaneously rotated 90° so that removable side 43 faces downward. Side 43 is now removed in order to allow the tips 31 of the lowest row of leaves to protrude slightly below box 20. In the rotated position ledges 42 serve to support the remote pointed ends of spikes 41 and thereby support the leaves in their vertical orientation. Box 20 is next lifted so that rollers 55 are approximately the same height as one set of tracks 50 and their corresponding extension tracks 54. Rollers 55 are first rolled onto extension tracks 54 and then rolled along tracks 50 until box 20 is wholly within barn 10.

Once barn 10 has been filled with 18 boxes 20, bolts 71, 72 are withdrawn in order to remove arms 53 and extension tracks 54. The doors to barn 10 are then closed so that the curing process may begin. Heater 12 and blower 11 are energized to force hot air past deflector 13 and baffle 14 and into plenum chamber 22. Pegboard 23 causes a uniform pressure to build in chamber 22 resulting in an even downward air flow through the tobacco and boxes 20. Initially, adjustable damper 18 is left in a fully open position to assure the complete removal of moisture from the circulating air through adjustable vents 19. As the curing process continues, damper 18 and vents 19 are progressively closed to essentially recirculate the blown air and thereby maintain a higher temperature for the final stages of curing. After the tobacco has been fully cured according to the preferences of the operator the contents of boxes 20 are much lighter due to the moisture loss in the leaves and may be removed from barn 20 by use of hoist 60 and extension tracks 54. The spike strips are now removed and the boxes 20 are unloaded into the conventional carrier means for transporting the cured leaves to market.

What is claimed is:

1. A method of handling and curing tobacco leaves comprising the steps of:

a. providing a conventional tobacco trailer or slide adapted for movement between rows of tobacco plants;

b. providing a parallelpiped curing box having a rectangular base adapted for support on said trailer or slide, said box having an open top and four interconnecting sidewalls, the opposed sidewalls along the longer dimension comprising a first porous sidewall and a second removable sidewall;

c. placing said box on said trailer or slide in a first orientation with said base facing downward and contacting said trailer or slide;

d. hand priming tobacco leaves and placing the primed leaves in said box in a plurality of rows with the stems directed toward said porous sidewall and the tips directed toward said removable sidewall;

e. filling said box with such leaves arranged in such rows;

f. providing a strip member for each row of tobacco leaves in said box, each said strip member including a plurality of spaced pointed spikes thereon, said spikes having a length approximately the depth of said box;

g. positioning each said strip member above one of said rows of leaves and depressing said strip member, thereby causing said spikes to pierce said leaves;

h. latching said strip members in place proximate the open top of said box;

i. supporting the spikes at their pointed ends;

j. moving said box to a tobacco barn having a hoist and at least one set of opposed tracks therein;

k. attaching said hoist to said box and rotating said box substantially 90° to a second orientation wherein said removable sidewall faces downwardly and said porous sidewall faces upwardly;

l. removing said removable sidewall;

m. lifting said box to a point where said rollers are at the same level as said tracks;

n. moving said box on its respective rollers on said tracks into said barn;

o. filling said barn with a selected number of said boxes and thereafter closing the doors to said barn;

p. curing said tobacco by down flow of heated air introduced into said barn at uniform pressure and velocity; and q. removing said boxes following curing and repeating said sequence.

2. The method of claim 1 including the step of baffling said heated air and forcing the baffled air into a plenum chamber and through a horizontal pegboard-like horizontal wall member to make the static pressure thereof uniform over said boxes.

3. The method of claim 2 including the step of placing said rollers on track extensions external of said barn prior to moving said boxes on said tracks.

4. A system to facilitate the handling and curing of tobacco leaves, comprising:

a. a substantially rectangular box for receiving hand primed tobacco leaves while said box is supported on a conventional trailer or slide between rows of tobacco and for mounting in a bulk curing tobacco barn for curing of said leaves by forced air currents, said box comprising:

i. a substantially rectangular base member serving as the box bottom and having a short dimension longer than an average tobacco leaf;

ii. a pair of oppositely disposed rectangular end wall members extending perpendicularly upward from and having one long dimension edge of each fixedly secured to a respective short dimension edge of said base member;

iii. a pair of rectangular oppositely disposed side panel members extending perpendicularly upward from said base member long dimension edges, a first such side panel member having its short dimensioned edges secured to mating short dimensioned edges of said end wall members and having one of the long dimensioned edges of said first side panel member secured to a long dimensioned edge of said base member and being porous so as to allow air flow therethrough and a second such side panel member being removable from said box, said base member, end wall members and side panel members when assembled forming a box having an open top for receiving said leaves;

iv. roller means on said end wall members proximate said first side panel member and adapted to roll along tracks within the barn; and v. hoist receiving means fixed to said box proximate said roller means;

b. a plurality of spike members providing a set of bar mounted spikes adapted to be directed downward through said open top to pierce said leaves, the length of said spike members adapted to extend to the inner surface of said base member;

c. latch means for holding said spike strip members in place on said box after the piercing of said leaves;

d. ledge means on said base member inner surface for supporting the tips of said spike members; and e. a bulk curing tobacco barn comprising;

i. a curing chamber for holding a plurality of said boxes for down-flow curing therein;

ii. hoist means adapted to be secured to each said box hoist receiving means and for lifting said box and rotating said box 90° to a second orientation whereby said first side panel member faces upward and said second side panel member faces downward allowing removal of such second side panel member;

iii. track means and track extension means for engaging said box roller means and rolling said box onto said track and into said barn;

iv. heater and blower means for heating and circulating the air within said barn;

v. adjustable air intake and venting means for controlling the amount of air to be recirculated during the curing process; and vi. a plenum chamber positioned above said curing chamber and adapted to receive heated air from said heater and blower means, said plenum chamber being bounded on the bottom by a sheet having uniformly spaced openings therein for maintaining a uniform static pressure, said sheet also forming the upper boundary of said curing chamber whereby said heated air may be forced through said sheet openings and downward through said boxes and thereafter recirculated according to said air intake and venting means, said sheet having in association therewith baffle means for introducing turbulence into the heated air flow as such flow enters said plenum chamber and being adapted to assist in establishing said uniform static pressure in said plenum chamber.

5. The system of claim 4 wherein said track extension means are removable.

6. A system to facilitate the handling and curing of tobacco leaves, comprising:

a. a substantially rectangular open top box for receiving hand primed tobacco leaves while said box is supported on a conventional trailer or slide between rows of tobacco and for mounting in a bulk curing tobacco barn for curing of said leaves by forced air currents, said box comprising:

i. a substantially rectangular base bottom member;

ii. a pair of oppositely disposed rectangular end wall members extending perpendicularly upward from and fixedly secured to said base member;

iii. a pair of side panel members extending perpendicularly upwardly from said base member and interfitting with said end wall members, a first such side panel member being formed as a mesh to allow air flow therethrough and a second such panel member being removable from said box, said base, end wall and side panel members forming a box having an open top for receiving said leaves;

iv. roller means on said end wall members proximate said first side panel member and adapted to roll along tracks within a curing barn; and v. hoist receiving means fixed to said box proximate said roller means;

b. a plurality of spike members providing a set of bar mounted spikes adapted to be directed downward through said open top to pierce said leaves, the length of said spike members adapted to extend to the inner surface of said base member;

c. latch means for holding said spike strip members in place on said box after the piercing of said leaves;

d. ledge means on said base member inner surface for supporting the tips of said spike; and e. a bulk curing tobacco barn comprising:

i. a curing chamber for holding a plurality of said boxes for down-flow curing therein;

ii. hoist means adapted to be secured to each said box hoist receiving means and for lifting said box and rotating said box 90° to a second orientation whereby said first side panel member faces upward and said second side panel member faces downward allowing removal of such second side panel member;

iii. track means and track extension means for engaging said box roller means and rolling each said box onto said track and into said barn;

iv. heater and blower means for heating and circulating the air within said barn;

v. adjustable air intake and venting means for controlling the amount of air to be recirculated during the curing process; and vi. a plenum chamber positioned above said curing chamber and adapted to receive heated air from said heater and blower means, said plenum chamber being bounded on the bottom by a pegboard-like sheet member having uniformly spaced openings therein for maintaining a uniform static pressure, said sheet member also forming the upper boundary of said curing chamber whereby said heated air may be forced through said sheet member openings and downward through said boxes and thereafter recirculated according to the adjustment of said air intake and venting means, said sheet member having in association therewith baffle means for introducing turbulence into the heated air flow as such flow enters said plenum chamber and being adapted to assist in establishing said uniform static pressure in said plenum chamber.

* * * * *

UNITED STATES PATENT OFFICE

CERTIFICATE OF CORRECTION

Patent No. 3,999,303 Dated Dec. 28, 1976

Inventor(s) William Kearns Martin; Dale Lamon Miller

It is certified that error appears in the above-identified patent and that said Letters Patent are hereby corrected as shown below:

Col. 5, line 27, "holes 26 on arms 27" should read --holes 27 on arms 26--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*